US005988993A

United States Patent [19]

Hauge

[11] Patent Number: 5,988,993

[45] Date of Patent: Nov. 23, 1999

[54] PRESSURE EXCHANGER HAVING A ROTOR WITH AUTOMATIC AXIAL ALIGNMENT

[76] Inventor: Leif J. Hauge, c/o Energy Recovery Inc., P.O. Box 65157, Virginia Beach, Va. 23467-5157

[21] Appl. No.: 08/849,092

[22] PCT Filed: Nov. 28, 1995

[86] PCT No.: PCT/NO95/00219

§ 371 Date: May 28, 1997

§ 102(e) Date: May 28, 1997

[87] PCT Pub. No.: WO96/17176

PCT Pub. Date: Jun. 6, 1996

[30] Foreign Application Priority Data

Nov. 28, 1994 [NO] Norway ..... 944558

[51] Int. Cl.[6] ..... F04B 17/00

[52] U.S. Cl. ..... 417/365; 60/39.45

[58] Field of Search ..... 60/39.45 A, 39.45; 417/365, 64, 406

[56] References Cited

U.S. PATENT DOCUMENTS

| | | | |
|---|---|---|---|
| 2,045,152 | 6/1936 | Lebre | 60/39.45 A |
| 2,800,120 | 7/1957 | Jendrassik | 123/119 |
| 2,864,237 | 12/1958 | Coleman | 60/39.45 |
| 3,074,622 | 1/1963 | Berchtold | 60/39.45 |
| 3,234,736 | 2/1966 | Spalding | 60/39.45 A |
| 4,487,552 | 12/1984 | Haase et al. | 417/64 |
| 4,887,942 | 12/1989 | Hauge | 417/64 |
| 5,522,217 | 6/1996 | Zauner | 60/39.45 |
| 5,567,129 | 10/1996 | Bonardi | 417/365 |

*Primary Examiner*—Charles G. Freay
*Assistant Examiner*—Robert Z. Evora
*Attorney, Agent, or Firm*—Young & Thompson

[57] ABSTRACT

A pressure exchanger for transfer of pressure energy from one fluid flow to another with direct mounting of a rotor in a housing. The rotor has a central supply manifold for lubricating fluid and step-shaped bearing surfaces with reduced gap clearance towards each rotor end. The lubricating medium flows towards a manifold at each end and from there to the low pressure side via the axial gap clearance. During axial movement of the rotor the manifold pressure increases when the gap clearance decreases at one end while the opposite occurs at the other end, resulting in an axially centering force in the gap surfaces. In the same way steps in the radial bearing surfaces generate a centering force, since a radial movement will cause an increased pressure gradient when there is a reduction of the gap clearance and a decreased pressure gradient when there is an increase in the gap clearance. The end pieces also have a curved countersink at each low pressure port which increases the drainage from the manifold. The rotor's ducts may be equipped with curved pressure partition walls. The end pieces have a pressure duct with direct connection to the high pressure port which pressurizes a limited segment of the pressure plate in order to balance deformations. The end pieces' inlet passages are designed with perpendicular flow cross sections in the form of segments of a circle.

9 Claims, 4 Drawing Sheets

PRESSURE EXCHANGER HAVING A ROTOR WITH AUTOMATIC AXIAL ALIGNMENT

BACKGROUND OF THE INVENTION

The invention relates to a pressure exchanger for transfer of pressure energy from one fluid flow to another, wherein the pressure exchanger comprises a housing with an inlet and an outlet duct for each fluid flow, a rotor which is arranged for rotation about its longitudinal axis in the housing, and which has at least one through-going duct, which extends from one end of the rotor to the other end, considered in the axial direction, and alternately connects the inlet duct and the outlet duct for one fluid with the outlet duct and the inlet duct respectively of the other fluid and vice versa during the rotation of the rotor.

DESCRIPTION OF THE RELATED ART

From NO-PS 161 341 (corresponding to U.S. Pat. No. 4,887,942) and NO-PS 168 548 amongst others there are known pressure exchangers of the above-mentioned type, where the rotor is positioned by means of a shaft which is mounted in a known manner in an opposite end cover. In most applications of pressure exchangers liquids are used with low viscosity, e.g. water. Any internal leakage between areas with high and low pressure could substantially reduce efficiency, leading to cavitation at the outlet if the sealing surfaces are not functioning satisfactorily, with a severely reduced working life as a consequence. If the use of dynamic and expensive sealing bodies which reduce reliability, complicate maintenance and cause severe friction are to be avoided, the alternative is a gap or slot seal which involves production and installation while complying with extremely accurate tolerances in order to be able to employ standard precision bearing components. The latter concept also involves problems in connection with elastic deformations of housing, rotor, and end cover at higher pressure which can only be partially solved by extreme overdimensioning of components.

The above patents further indicate partition walls in the rotor ducts which have radial cross sections with straight walls or walls in the form of opposite sections of segments of a circle. The former shape is unsatisfactory with regard to fatigue in the attachment points due to elastic deformations when alternating between high and low pressure and they require to be overdimensioned. Both shapes reduce the available flow cross section and thereby the efficiency. The mixing of the liquid flows is also influenced by the ratio between available individual flow cross section and the length of the ducts. In special applications the noise level will be of vital importance and in this respect the described duct cross sections are not the most desirable.

NO-PS 161 341 describes an end cover which has inlet and outlet passages with a larger surface and pressure drop than necessary, since the flow will always be turbulent.

BRIEF SUMMARY OF THE INVENTION

The object of the invention is to provide a pressure exchanger which is not encumbered by the above-mentioned disadvantages.

The characteristics of this pressure exchanger according to the invention are indicated by the characteristic features described below and in the claims presented.

BRIEF DESCRIPTION OF THE DRAWINGS

The invention will now be described in more detail with reference to the drawings which schematically illustrate examples of a pressure exchanger according to the invention.

DESCRIPTION OF THE PREFERRED EMBODIMENT

Figure 1:
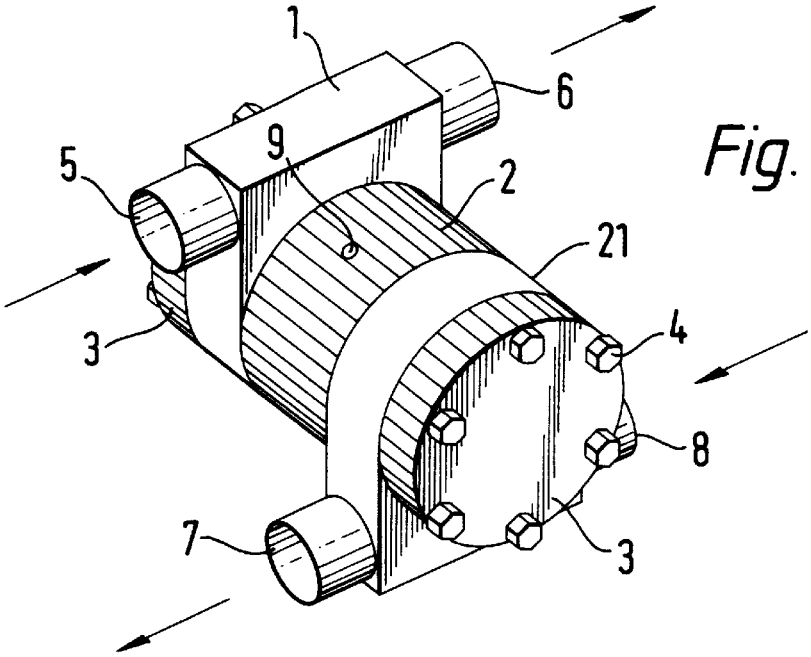
FIG. 1 is a perspective view of an embodiment of a pressure exchanger according to the invention.

As is evident in FIG. 1 an embodiment of a pressure exchanger comprises a housing 2 with end pieces 1 and 21 together with identical pressure plates or end covers 3 which are connected with through-going bolts 4. The housing 2 has a central opening 9 for the supply of lubricating fluid. Furthermore the end piece 1 has an inlet 5 for high pressure and an outlet 6 for low pressure. The end piece 21 has an inlet 8 for low pressure and an outlet 7 for high pressure.

Figure 2:
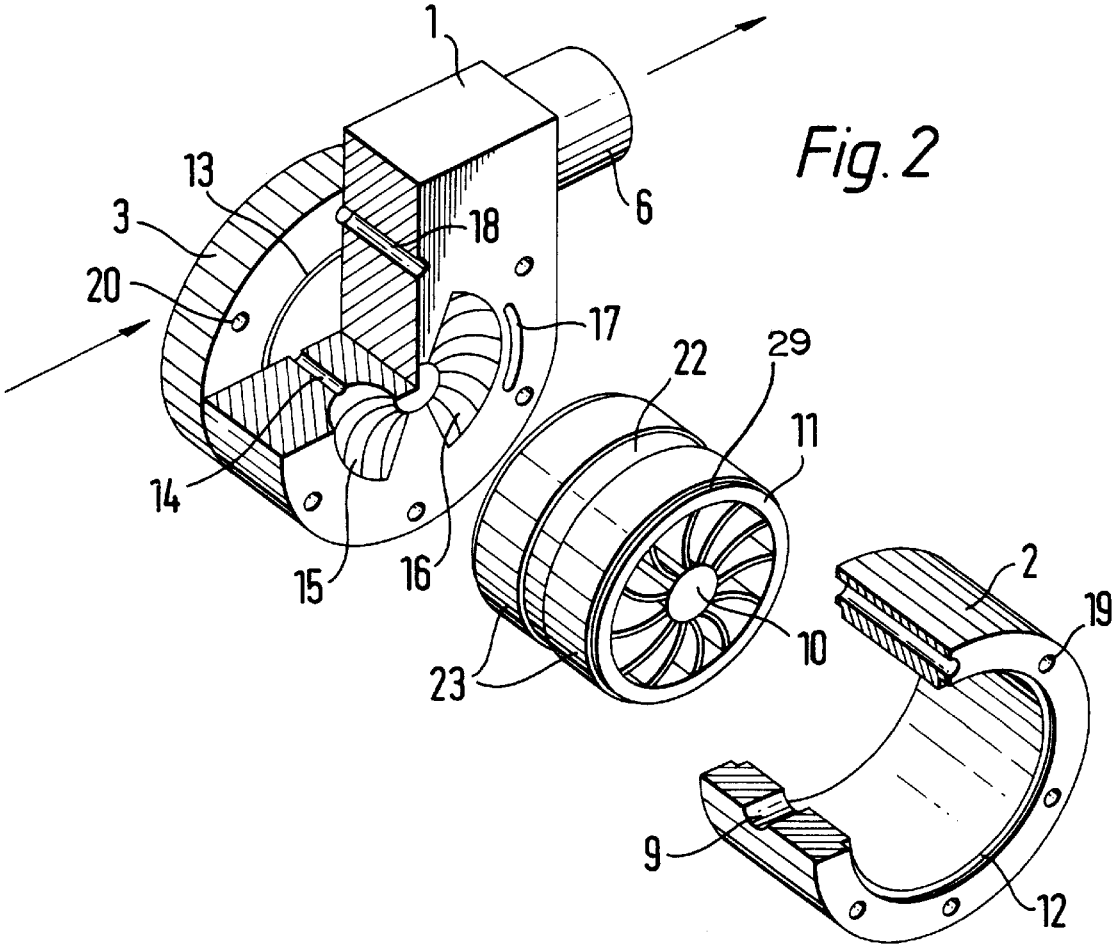
FIG. 2 is a perspective view of the components of the pressure exchanger illustrated in FIG. 1, but where its components are separated from one another and for some of these portions are cut away.

FIG. 2 shows the different components, where a rotor 10 uses the housing 2 for positioning and mounting. The rotor 10 has a groove 22 which is positioned between the ends of the rotor and together with an adjacent section of the housing 2 defines a central or first supply manifold which receives lubricating fluid via the opening 9 in the housing 2. The lubricating fluid can advantageously be one of the liquids which is exposed to the pressure exchange and flows towards the ends 11 of the rotor 10, which ends 11 together with respective ends of the housing 2 define a second or at each end of the rotor 10. From here the second manifold 29 is drained via an end clearance between the rotor and the end cover on the low pressure side. The rotor's external bearing surfaces 23 are in the form of a step bearing and the housing's internal surfaces have extremely small clearances in which there is only room for a lubricating film. Similarly a clearance between the rotor's end surfaces and end pieces provides an axial lubricating film and a gap seal between areas with high and low pressure. Moreover the housing 2 has a statically sealing O-ring 12 at each end together with through-going holes 19 for bolts.

The end piece 1 has a cut-out on the high pressure side which exposes the inside of the pressure plate 3 with a through-going hole 20 for bolts which absorb the separation forces. A static sealing ring 13 defines an internal area which is pressurized via a pressure duct 14 which is directly connected to a high pressure port 15, thus balancing to as great an extent as possible any deformations due to pressure loads in the axial end surfaces between rotor and end piece. Furthermore the requirement for prestressing the housing will be minimal, since virtually all separation forces are absorbed in the pressure plate via the through-going bolts. The end piece has through-going holes 18 for bolts, and at the low pressure port 16 there is located a curved countersink 17. The object of this countersink is to increase the drainage from the second manifold 29 of the rotor, thus increasing the pressure difference over the bearing surfaces 23 and the hydrostatic bearing function. In addition this countersink will also reduce the possibility of the rotor being stuck to the end cover by suction in the event of misalignment during start-up. The end pieces' inlet and outlet passages and the port openings 15 and 16 are designed to the greatest possible extent with perpendicular flow cross sections in the form of segments of a circle.

Figure 3:
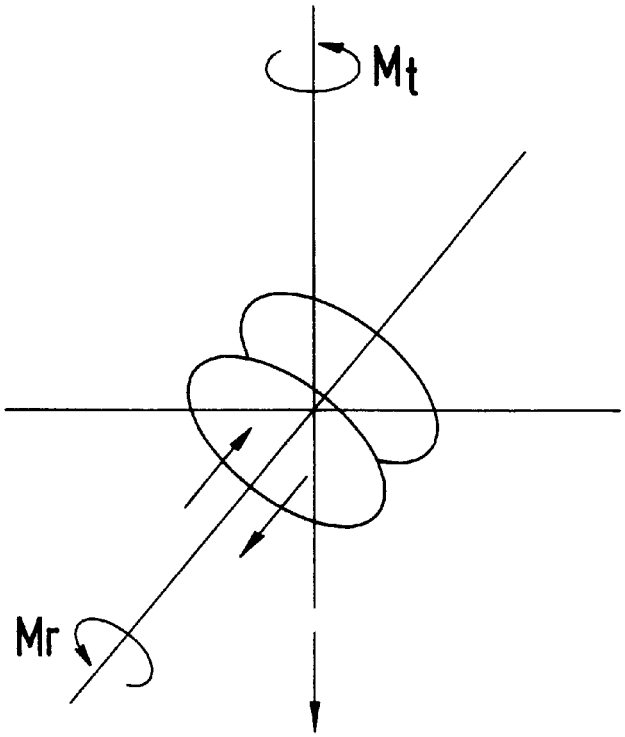
FIG. 3 is a diagram illustrating the forces which act on a rotor during through-flow of fluid during rotation.

FIG. 3 illustrates the forces which act on the rotor during through-flow and rotation, where Mr is a torque which is supplied from the liquid flows or the driving source. Mt is a twisting moment which is created by the opposite liquid flows which attempt to rotate the rotor in a plane through the liquid flows. The rotor's natural position within the housing and the end pieces is therefore asymmetrical, despite hydrostatic and hydrodynamic bearing forces which attempt to correct the position. This is most obvious during start-up since the hydrodynamic forces only come into effect once a certain rotative speed has been reached. The frictional forces take effect instantaneously as soon as a through-flow is established, while due to inertia it takes more time to build up rotation in liquid operation. At a given moment the rotor will then be in maximum misalignment, and on the low pressure side the pressure gradient in the gap clearance at the outlet end, which passes fluid from the second manifold 29 to the low pressure port 16 can become considerably lower than at the opposite gap clearance, thereby causing the rotor to be locked. The countersink 17 counteracts this, by maximizing the hydrostatic pressure difference, and the effective gap length and thereby the forces are reduced proportionally in the most sensitive area, where the rotor's external axial surface comes into closest contact with the end piece. This is not the case on the high pressure side as long as the direction of flow in the gap is from the high pressure port to the second manifold 29. In the event of misalignment centering forces will be exerted, higher pressure arising in the gap which is defined in the direction of flow. On the low pressure side the opposite occurs, since in the event of misalignment the pressure in the gap which has increasing cross section in the direction of flow will drop, thereby increasing the misalignment and resulting in a surface contact.

Figure 4A:
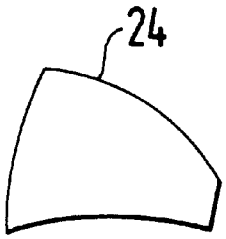
FIG. 4 shows possible optimum cross section shapes for rotor ducts.
Figure 4B:
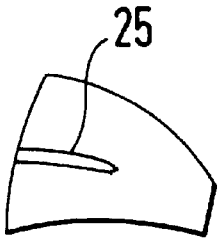
Figure 4C:
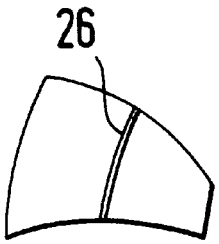

FIG. 4 illustrates optimum duct cross sections for the rotor, where (a) is a fundamental design in which the pressure partition wall 24 is in the form of a segment of a circle. A design of this kind minimizes the wall thickness and the flow resistance due to contraction of the flow cross section. The pressure partition wall 24 is alternately exposed to tension and contraction, and must therefore be dimensioned with regard to fatigue in the attachment points, and a circular shape therefore provides the greatest strength with the least cross section. Shape (b) has a center fin 25 which reduces the dead volume required in the duct and reduces noise from fluid-driven rotation of the rotor, a torque also being supplied via the center fin, thereby reducing the angle of attack required to produce a necessary lift. Shape (c) has a supporting wall 26 which reduces the wall thickness required for the partition wall 24, thereby effectively increasing the effective flow cross section while simultaneously reducing the dead volume required for an effective separation of the fluids which are exposed to a pressure exchange.

Figure 5:
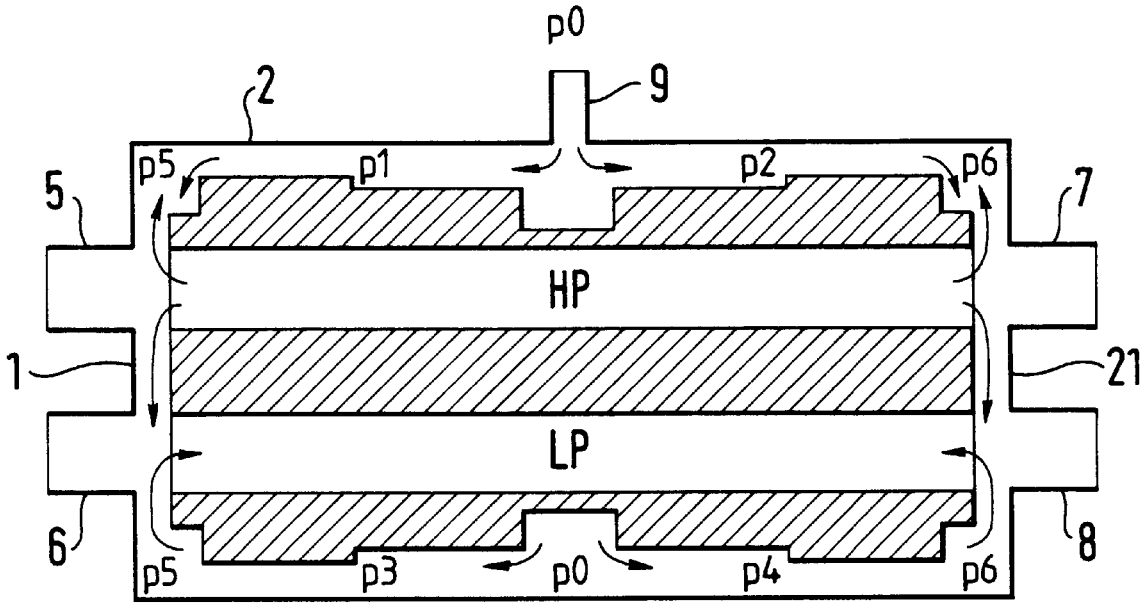
FIG. 5 is a schematic functional diagram for mounting of the rotor with straight ducts.

FIG. 5 illustrates schematically how the hybrid bearing system works for a rotor with opposite outlets for the ducts at equal radial intervals, the boundary of the end pieces and the housing being illustrated in cross section as an external boundary and a cross section of the rotor is located inside with exaggerated clearances in order to illustrate the principle function of the hydrostatic mounting of the rotor. Lubricating fluid is supplied via the opening 9 at pressure p0 and flows towards the rotor's end manifold. The rotor has a step which causes a reduction in the gap clearance towards each end. Since the pressure drop is proportional to the flow resistance, the pressure gradient in the gap clearance will be greatest at the point where the clearance is least. This leads to pressure points p1 and p2 which indicate the transition between the radial pressure gradients and the rotor's end manifold at pressure p5 and p6 respectively. Assuming that the lubrication pressure p0 is not substantially greater than HP, fluid will flow from the high pressure ducts into the rotor's end manifold which has a uniform pressure over the entire periphery. On the low pressure side the flow is similarly radial and p3 and p4 mark the distinction between the pressure gradients. Here, however, the rotor's end manifold is drained towards the low pressure ducts. There is a continuous internal leakage of liquid from the high pressure side directly to the low pressure side via the gap clearance between the rotor's central surface, the rotor ducts' end surfaces, the end pieces' central surfaces, and sealing surfaces between the port openings.

If the rotor is located symmetrically centrally within the boundary which is established by the housing and the end pieces, the following will apply; p1=p2=p3=p4, and p5=p6.

Figure 6:
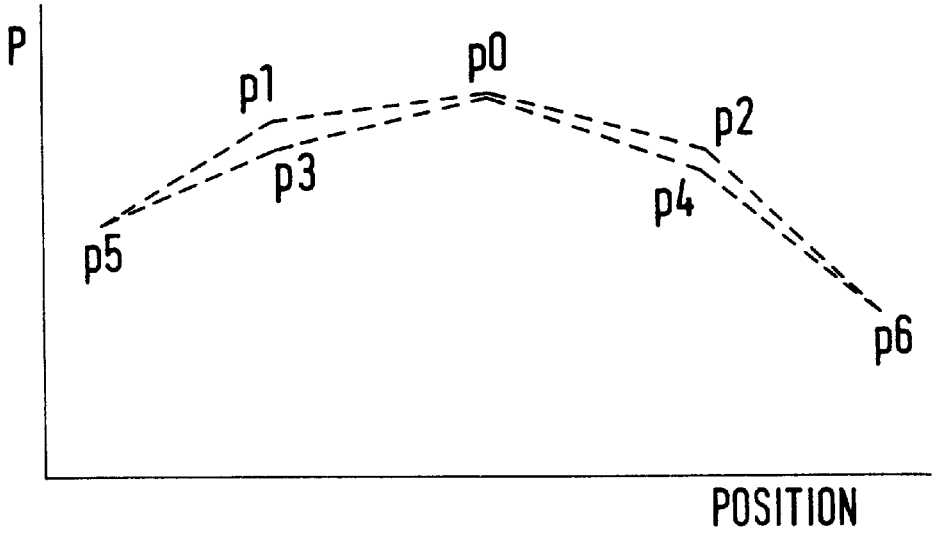
FIG. 6 illustrates corresponding hydrostatic pressure distribution on the rotor's surfaces during axial and radial movement from a central position.

FIG. 6 illustrates how the bearing system reacts if the rotor deviates from this position. If the rotor is influenced by a force which moves the rotor in the direction towards the end piece 1, the gap clearance will be reduced here while it will increase at the opposite end piece. This results in p5>p6, since the drainage requires a greater pressure drop when there is an increase in flow resistance, and a reduction in the pressure drop required at the opposite end. The substantial difference in pressure gradient produces a force which acts in the opposite direction, and which attempts to correct the axial position until the rotor once again has a central axial position. Similarly, in the case of radial position deviation, which can be illustrated by the fact that the rotor is moved in the direction towards the high pressure side, the pressure point p1>p3, since the ratio between the flow resistance from p1 to p5 and the flow resistance from p0 to p1 increases, while the ratio between the flow resistance from p3 to p5 and the flow resistance from p0 to p3 decreases. The same applies to p2 >p4 and in total this difference in pressure gradients results in a net force which counteracts radial deviation from a symmetrical central position.

Figure 7C:
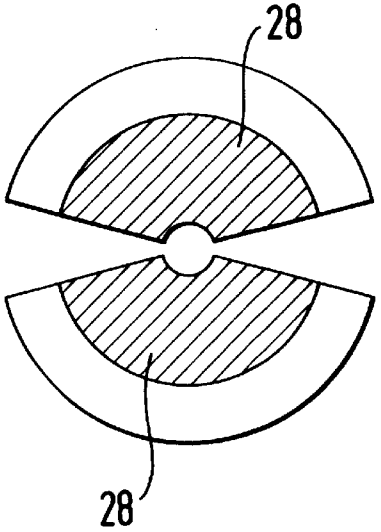
FIG. 7 is a schematic functional diagram for mounting of the rotor with ducts which have opposite outlets at different radial distances.
Figure 7B:
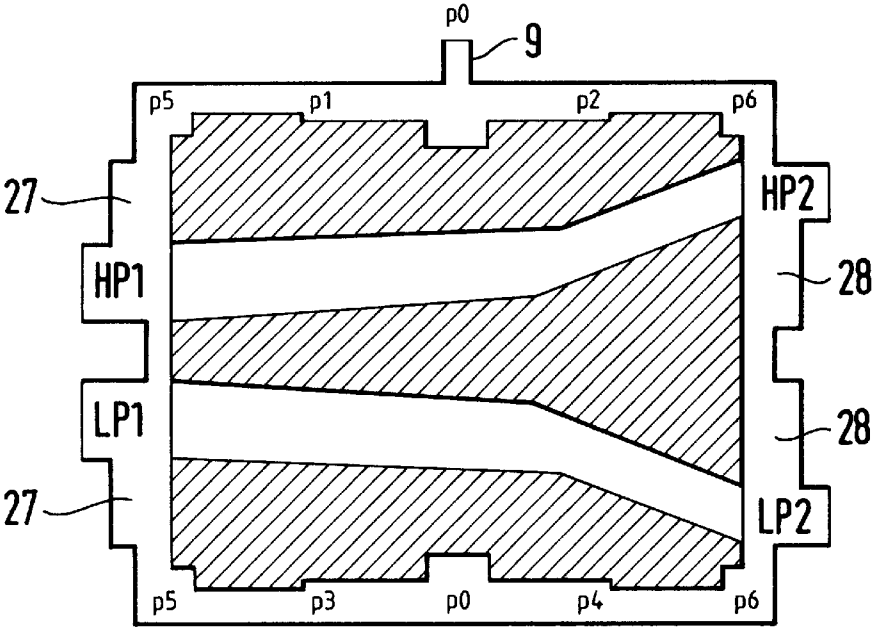
Figure 7A:
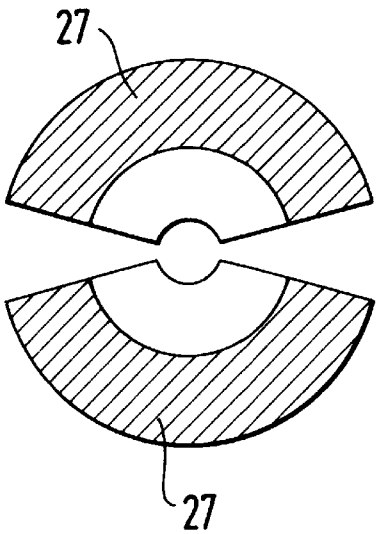

FIG. 7 similarly illustrates how this bearing system will function for positioning of a rotor with ducts which have opposite outlets at different radial distance. During rotation additional pressure is produced in the ducts HP2−HP1=LP2−LP1 which is generally moderate in relation to HP—LP, and this will have little effect on a bearing system of the type which is described in connection with FIGS. 5 and 6. However, the different radial intervals or distance of the duct outlets results in opposite axial areas which are exposed to different pressure forces in the gap clearances when the rotor is in a central, symmetrical position. This leads to unbalanced resultant forces which will cause the rotor to be locked or misaligned. Thus it is necessary to introduce balancing areas or regions 27 and 28 in the end pieces as compensation. The areas represent complementary areas produced by an opposite axial projection of port openings, the rotor's clearance between the end pieces thereby being exposed to equally large areas under high pressure or low pressure. In order to achieve this the areas 27 and 28 must appear in the form of a countersink in the end pieces' surfaces with a depth which distributes the port pressure evenly within the shaded area.

Figure 8:
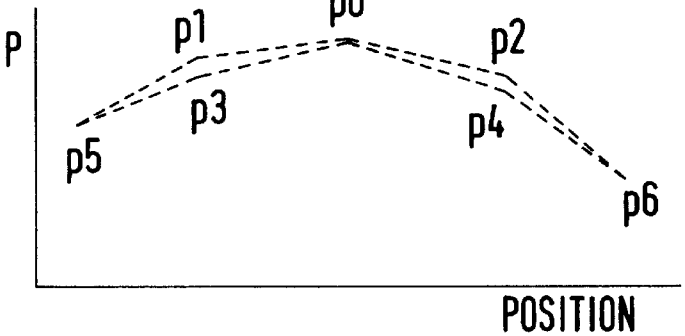
FIG. 8 illustrates corresponding hydrostatic pressure distribution on the rotor's surfaces during axial and radial movement from a central position.

FIG. 8 is a diagram of the pressure gradients during axial and radial movement. This will have substantially the same character as in FIG. 6 if the above-mentioned balancing areas 27 and 28 are included in the design of the end pieces.

I claim:

1. A pressure exchanger for transfer of pressure energy from a fluid flow of one fluid system to a fluid flow of a second fluid system, comprising:

a housing (2) having a longitudinal axis, and a pair of end pieces (1 and 21 respectively) abutting the housing and centrally located on the longitudinal axis, each of the end pieces respectively, has a pair of passages defined by an inlet and an outlet (5, 6 and 8, 7 respectively) for fluid flow, and a cylindrical rotor casing having an inside and an outside surface, the cylindrical rotor casing (10) is provided in the housing (2), the rotor casing is comprised of a shaftless arrangement of a plurality of fins defining through-going ducts, the rotor rotates about the longitudinal axis, said rotor has the plurality of through-going ducts which are open at each end and arranged symmetrically on the inside surface of the rotor casing about the longitudinal axis, the rotor ducts are connected with the inlet and outlet passages of the end pieces to alternately lead the fluid at high pressure and the fluid at low pressure from the respective systems, wherein a section of the rotor (10) between the ends thereof and on adjacent section of the housing define a first supply manifold (22) for a lubricating fluid wherein said first supply manifold is recessed radially on the outside surface of the rotor 10 and is located between a pair of bearings disposed radially about the outside surface of the rotor casing and located adjacent to the ends of the rotor casing, each of the bearings separate the first manifold from a pair of second manifolds a reduced clearance towards the end of the rotor defined between the ends of the rotor (10) and the respective end surfaces of the housing, the second manifold fluidly communicates the lubricating fluid towards a low pressure side of the pressure exchanger in order to simultaneously provide an axial reaction force to return the rotor casing to a central location within the housing and the end pieces whereby selected symmetrical pressure locations between the housing and the rotor casing are equal.

2. The pressure exchanger of claim 1, wherein each of the pair of end pieces (1 and 21 respectively) comprise a countersunk balancing area (27 and 28 respectively) which define approximately identical opposite areas.

3. The pressure exchanger of claim 2, wherein each of the pair of end pieces (1 and 21 respectively) comprise a curved countersink (17) adjacent a low pressure port (16) adapted to increase radial drainage and the pressure gradient and to counteracting locking of the rotor in misalignment.

4. The pressure exchanger of claim 2, further comprising a pressure plate mounted with through-bolts to each of the pair of end pieces and a static sealing ring located intermediate each pressure plate and associated end piece to define an internal segment restricted by the static sealing ring and pressurized via a pressure duct in direct connection to a high pressure port, wherein each pressure plate is adapted to absorb separation forces via the associated through-bolts.

5. The pressure exchanger of claim 1, wherein each of the pair of end pieces (1 and 21 respectively) comprise a curved counters ink (17) adjacent a low pressure port (16) adapted to increase radial drainage and the pressure gradient and to counteracting locking of the rotor in misalignment.

6. The pressure exchanger of claim 1, wherein the rotor (10) comprises ducts with curved pressure partition walls (24).

7. The pressure exchanger of claim 6, wherein said ducts further comprise one of a central fin or a radial supporting portion wall.

8. The pressure exchanger of claim 1, further comprising a pressure plate mounted with through-bolts to each of the pair of end pieces and a static sealing ring located intermediate each pressure plate and associated end piece to define an internal segment restricted by the static sealing ring and pressurized via a pressure duct in direct connection to a high pressure port, wherein each pressure plate is adapted to absorb separation forces via the associated through-bolts.

9. The pressure exchanger of claim 1, wherein each of the pair of end pieces further comprise a high and a low pressure port and an inlet and an outlet passage constructed to define cross sections perpendicular to the intended direction of fluid flow in the high and low pressure ports comprising segments of a circle whose area within each port varies approximately as $(1+\sin\alpha/2)$ where $\alpha$ extends 90–270 degrees from a start edge of the port to the end edge thereof considered in the direction of fluid flow.

* * * * *